US006725484B2

(12) United States Patent
Drenik

(10) Patent No.: US 6,725,484 B2
(45) Date of Patent: Apr. 27, 2004

(54) MULTI-FUNCTIONAL BED EQUIPPED WITH DIFFERENT TYPES OF FITTINGS

(76) Inventor: Gary August Drenik, Via Mercatelli 10/a, 31010 Ponte della Priula (IT)

( * ) Notice: Subject to any disclaimer, the term of this patent is extended or adjusted under 35 U.S.C. 154(b) by 0 days.

(21) Appl. No.: 10/223,343

(22) Filed: Aug. 19, 2002

(65) Prior Publication Data

US 2003/0126682 A1 Jul. 10, 2003

(30) Foreign Application Priority Data

Jan. 10, 2002 (IT) ..... PN2002A0002

(51) Int. Cl.[7] ..... A47C 17/00; A47C 21/00; A47C 31/00

(52) U.S. Cl. ..... 5/658; 5/904; 5/905

(58) Field of Search ..... 5/658, 904, 905

(56) References Cited

U.S. PATENT DOCUMENTS 1,582,487 A * 4/1926 Shank ..... 5/658 X
3,889,910 A * 6/1975 Walters ..... 5/122.1
4,903,353 A * 2/1990 Park ..... 5/904 X
5,459,893 A * 10/1995 Walters, III ..... 5/658 X

* cited by examiner

*Primary Examiner*—Heather Shackelford
*Assistant Examiner*—Sunil Singh
(74) *Attorney, Agent, or Firm*—Bucknam and Archer

(57) ABSTRACT

Bed equipped with different types of fittings having a horizontal support plane for supporting a mattress spring, a mattress, pillows and blankets and a person and including a first and a second pair of vertical legs (15, 16, 17, 18) arranged respectively near the bed headboard and the bed footboard, which extend upwardly and which are joined together by a first stiff structure (19) arranged on the lower part thereof forming the bed peripheral edges (20, 21) and the horizontal support plane. A second stiff structure (22), is arranged on the upper part of the vertical legs spaced vertically from the first stiff structure (19) in such a manner as to allow easy access to the bed. The second stiff structure (22) having peripheral edges (22, 23, 24, 25) adapted to support at least a television receiver (27, 32), a bar (28) for supporting gym equipment and a lamp (60).

7 Claims, 9 Drawing Sheets

MULTI-FUNCTIONAL BED EQUIPPED WITH DIFFERENT TYPES OF FITTINGS

BACKGROUND OF THE INVENTION

The invention relates to a bed for sleeping which is equipped with different types of fittings, adapted to ensure comfortable sleeping and also permit physical exercises for the person lying on or using the bed.

As is known, beds which are presently manufactured are shaped for supporting one or two persons and to this aim they are normally constituted by two side edges, a headboard and a footboard, which are structured in such a manner so as to be joined reciprocally and are shaped with different forms, versions and sizes. As a result such beds are not adapted to perform other functions.

SUMMARY OF THE INVENTION

The object of the present invention is to provide a bed adapted to ensure greater comfort to the person or persons lying thereon and to allow them also to perform physical exercises without the need to sit up on the bed.

The above object is accomplished according to the present invention by the provision of a multi-functional bed equipped with different types of fittings having a horizontal support plane for supporting a mattress spring, a mattress, pillows, blankets and at least one person, comprising a first and a second pair of vertical legs arranged respectively near the bed headboard and the bed footboard, which extend upwardly and which are joined together by a first stiff structure arranged on the lower part thereof forming the bed peripheral edges and the horizontal support plane. A second stiff structure is arranged on the upper part of the vertical legs spaced vertically from the first stiff structure in such a manner as to allow easy access to the bed. The second stiff structure is provided with peripheral edges adapted to movably support a television receiver and a bar for supporting gym equipment.

BRIEF DESCRIPTION OF THE DRAWINGS

The invention will be better understood from the following description, given solely by way of not-limitative example and with reference to the accompanying drawings, wherein.

DETAILED DESCRIPTION OF THE INVENTION

Figure 1:
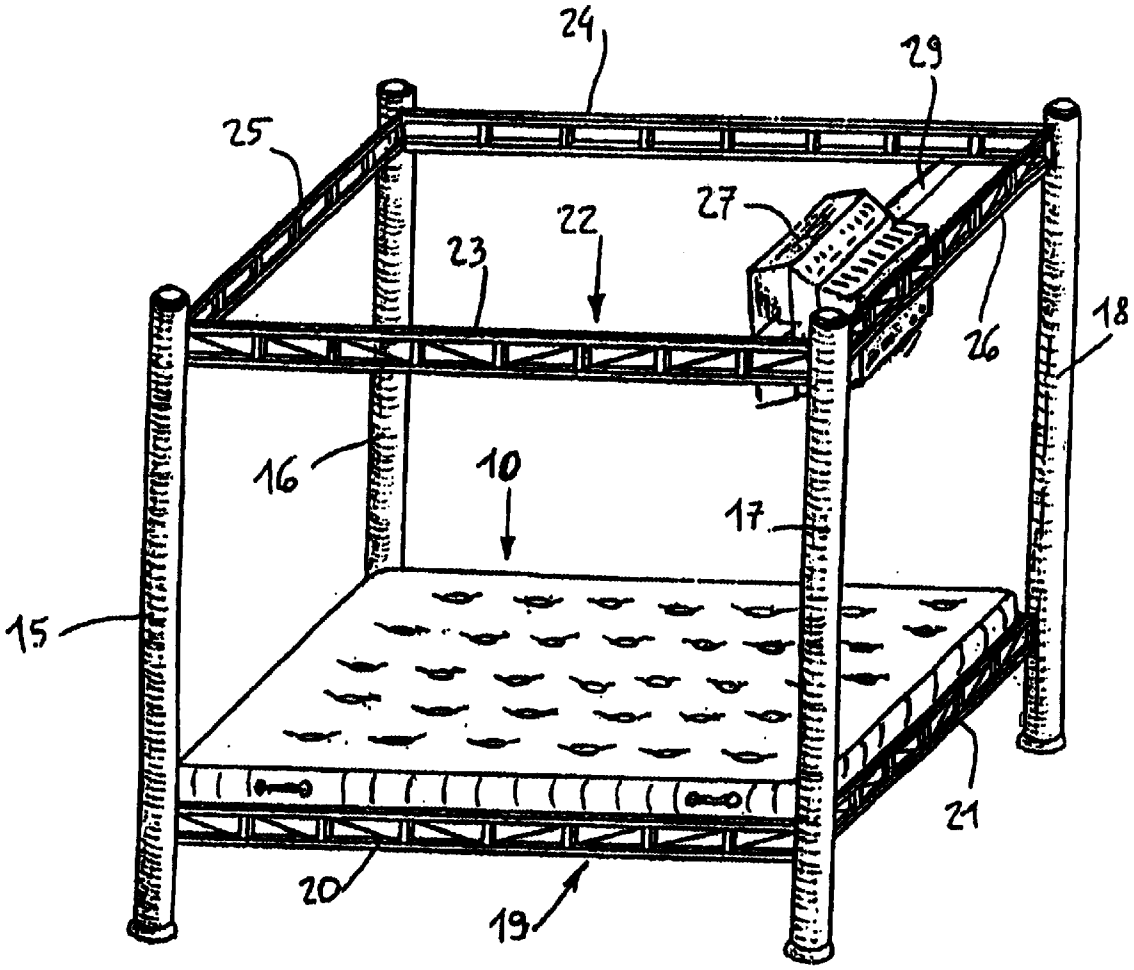
FIG. 1 is a perspective front view of a bed according to the invention, equipped with different fittings, in a first embodiment thereof.
Figure 2:
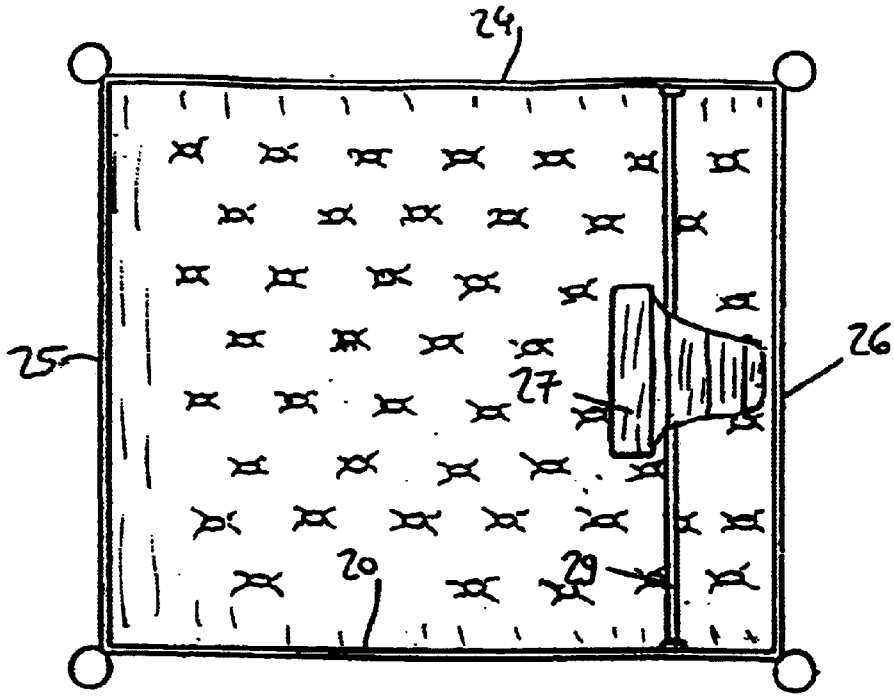
FIG. 2 is a plan view of the bed of FIG. 1.
Figure 10:
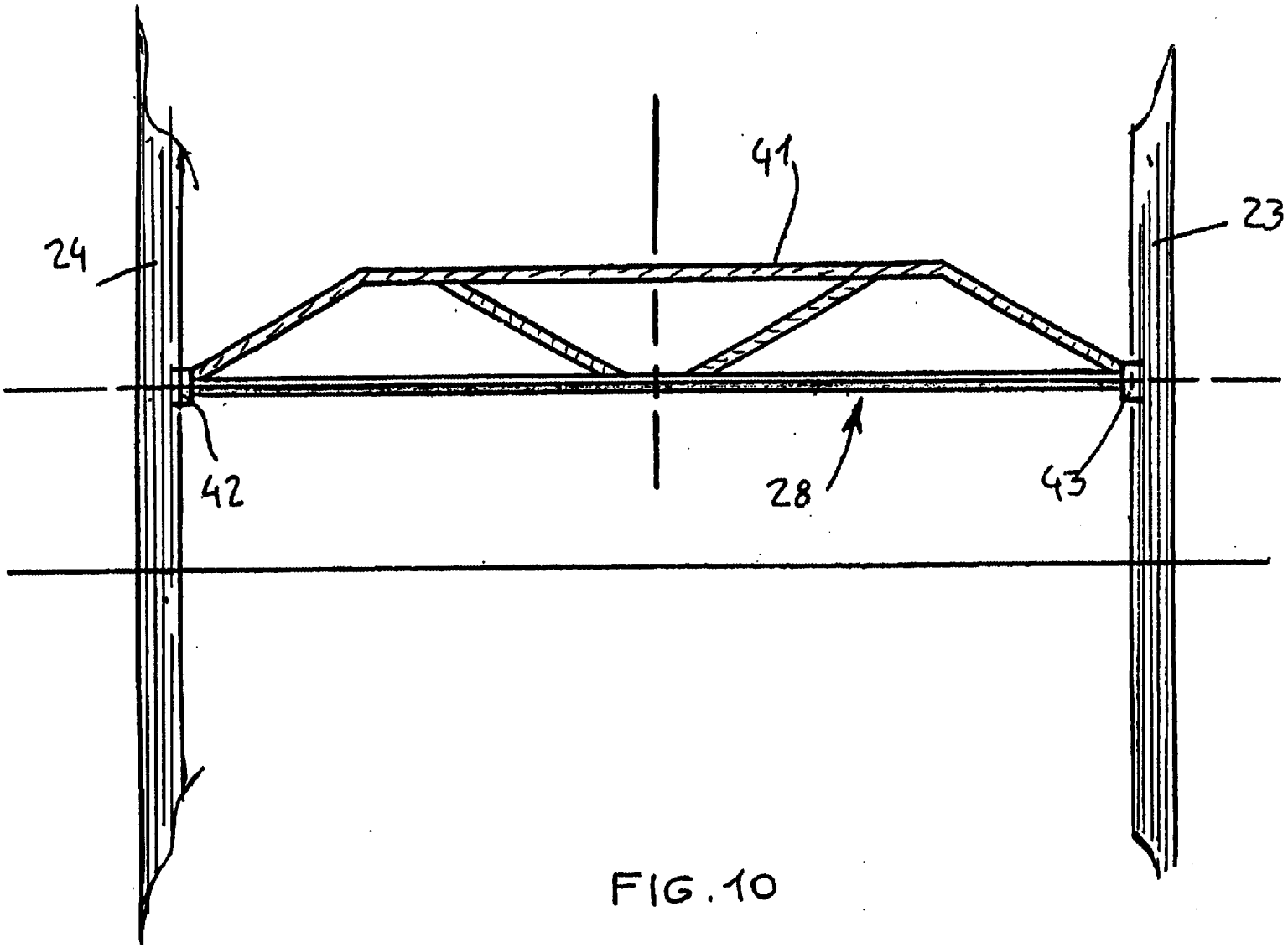
FIG. 10 is a side view of another constructive component of the bed according to the invention.

The above mentioned Figures schematically represent a multi-functional bed 10 equipped with different fittings, which will be described hereafter, adapted to ensure comfortable sleeping and to also permit physical exercises for the person or persons lying down on the bed. The bed substantially comprises a first pair of identical vertical legs 15 and 16 spaced transversally from each other for the entire bed width (which bed is for one or two persons), and which legs are arranged near the bed headboard, and by a second pair of identical vertical legs 17 and 18 arranged spaced transversally from each other as the previous legs and which are spaced away from these latter for the entire bed length and arranged near the bed foot-board. All the cited vertical legs are joined reciprocally by a first stiff structure 19 arranged on the lower portion of the legs, adequately raised from the floor and forming the bed peripheral edges (FIG. 1 shows the front edge 20 and the back edge 21) and also a horizontal support plane (not numbered) for supporting a mattress spring, a mattress, pillows and blankets as well as a person or persons. Moreover, these vertical legs are joined reciprocally also by a second stiff structure 22 arranged on the upper portion of the legs and spaced away vertically from the first stiff structure in such a manner as to allow easy access to the bed, which structure is constituted by peripheral edges formed by side edges 23 and 24 and front and back edges 25 and 26, and the function of which is to support at least a television receiver 27 and a horizontal transverse bar 28 for performing physical exercises (see FIG. 10). In particular, in the present example, the television receiver 27 is a common television receiver provided with a television tube and is secured onto and supported by a transverse rectilinear bar 29. The free end portions of bar 29 are provided with wheels 30 or similar sliding means (see FIGS. 5 and 6) engaging corresponding side guide members (not shown) fixed against side edges 23 and 24. This mounting permits longitudinal sliding of both the bar 29 and the television receiver 27 from a position near the back edge 26 of the stiff structure 22 to a position approaching the head of the person lying on the bed, or it allows the television receiver to be raised perpendicularly above the person, thereby allowing the person to see the television programs when they are disposed lying down on the bed.

Figure 3:
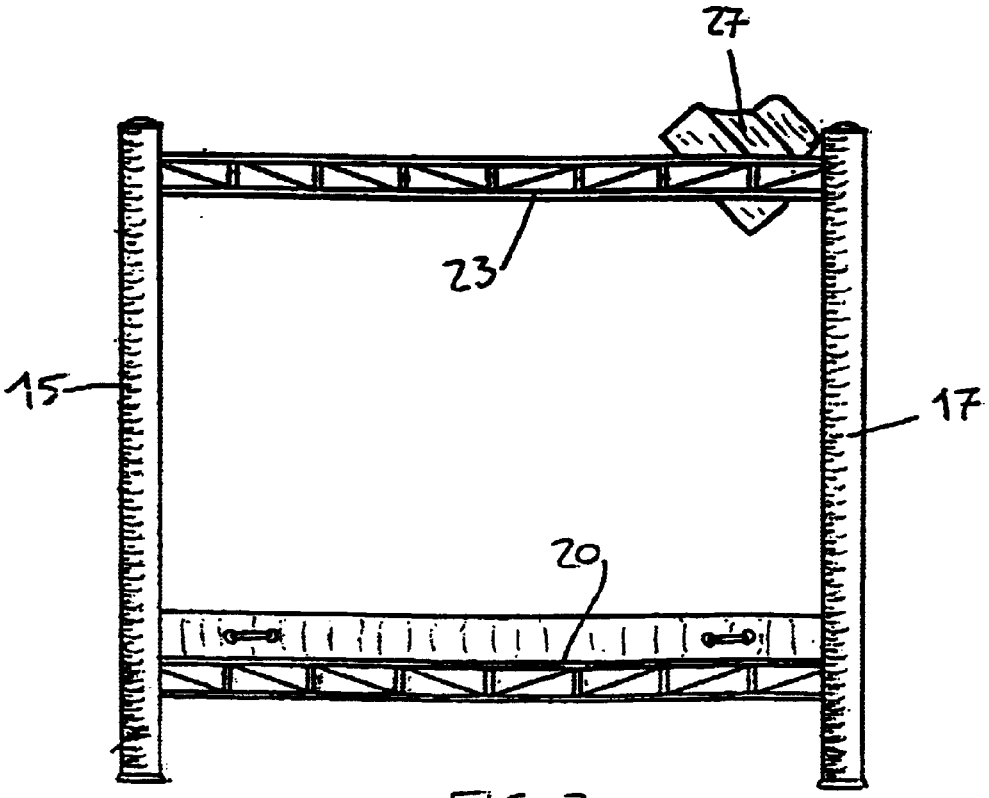
FIG. 3 is a side view of the bed of FIG. 1.
Figure 4:
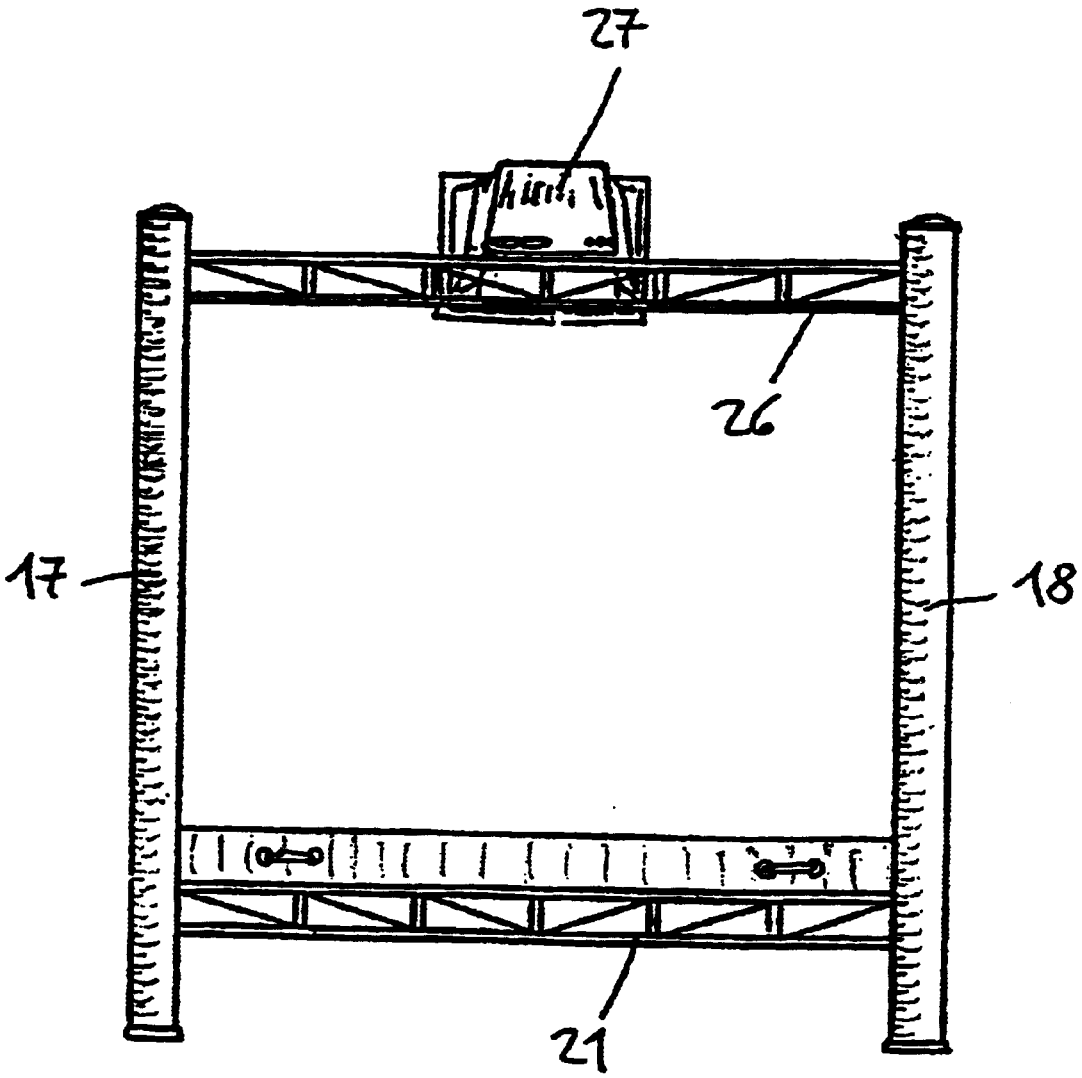
FIG. 4 is a rear view of the bed of FIG. 1.
Figures 5, 6:
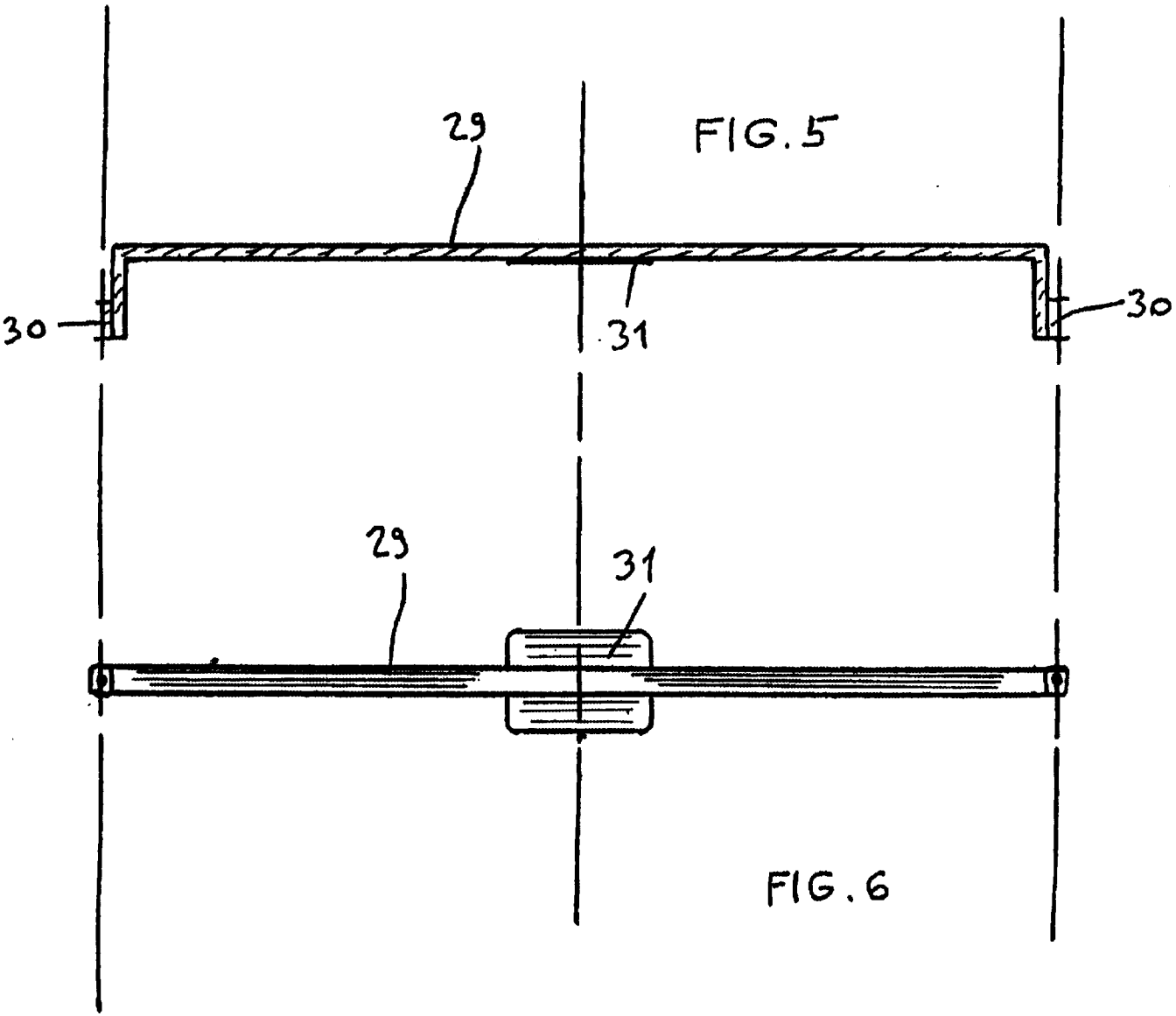
FIG. 5 is a transverse view of a constructive component of the bed of FIG. 1.
FIG. 6 is a plan view of the constructive component of FIG. 5.

As seen in FIGS. 5 and 6, a horizontal plate 31 having a sufficient length for securing and supporting the television receiver 27 is inserted on the transverse bar 29. Plate 31 is slidable for the entire extent of bar 29 with the possibility of displacing the television receiver also in the transverse direction for the entire transverse extent of bar 29. Finally, according to the present invention it is also possible to adjust the television receiver 27 to different angular positions with respect to the person lying on the bed, for example by rotating bar 29 about its axis and by keeping the television receiver stationary with respect to the bar or by keeping the bar stationary and by rotating solely the television receiver with its plate 31 around the bar, manually or mechanically by means of suitable regulating means. FIGS. 1 and 3 show the television receiver adjusted with the described criteria to different angular positions, with consequent adjustment of the position of the television screen with respect to the person disposed lying on the bed.

Horizontal transverse bar 28 for performing physical exercises, which is not visible in FIGS. 1–6, is supported by the second stiff structure 22, in a position between the bar 29 for television receiver 27 and the opposite edge 25 of stiff structure 22, and may be slid along structure 22 to different positions as will be described hereinafter, depending on the needs of the person wishing to perform physical exercises.

Figure 7:
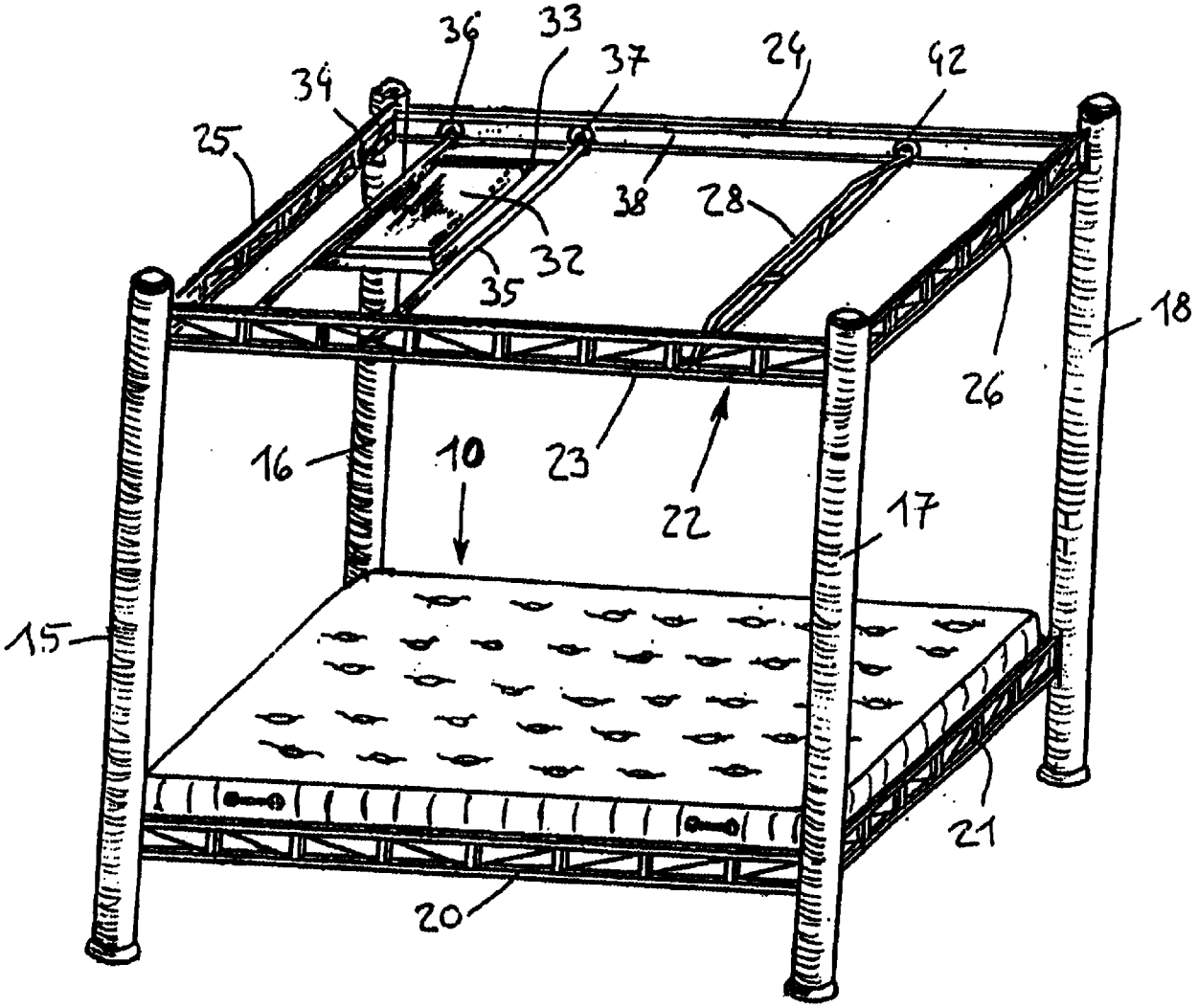
FIG. 7 is a perspective front view of a bed according to the invention, in a second embodiment thereof.
Figures 8, 9:
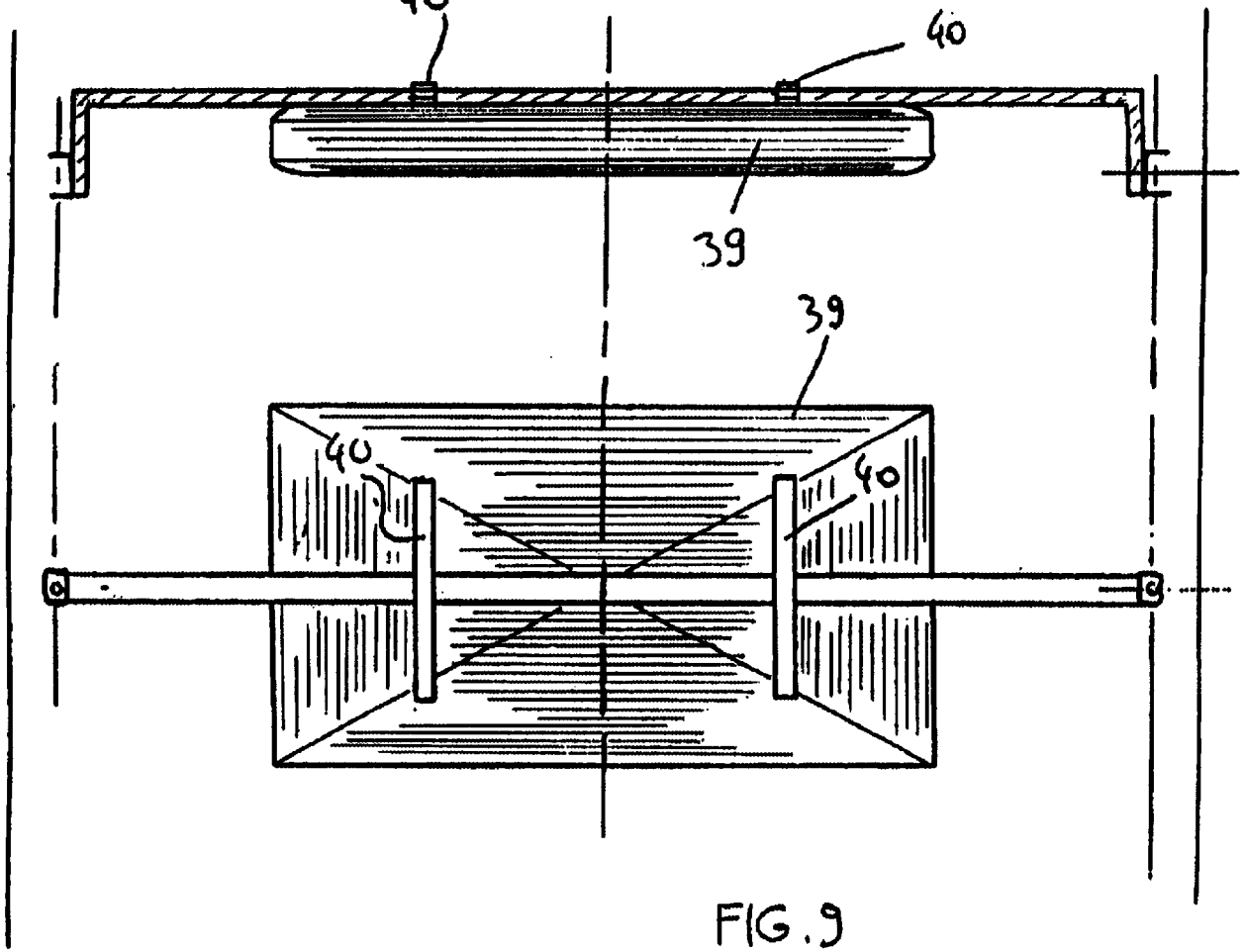
FIG. 8 is a transverse view of a constructive element of the bed of FIG. 7.
FIG. 9 is a plan view of the constructive element of FIG. 8.

FIG. 7 shows a bed according to the invention in a second embodiment, in which it is noted that in this case it is made with the same components as the previously described bed, and is arranged for supporting a television receiver 32 with a flat screen and a horizontal transverse bar 28 for physical exercises. To support television receiver 32, a stiff support frame 33 onto which such television receiver is fixed is provided, and this frame is supported by a pair of additional transverse bars 34 and 35, provided at their free ends with associated wheels 36 and 37 or similar sliding means. Wheels 36 and 37 are slidable along corresponding side guide members 38 of side edges 23 and 24 of stiff structure 22, thereby allowing television receiver 32 to be displaced to different positions depending on the needs of the person lying on the bed. As seen in FIG. 7, television receiver 32 is positionable between the front edge 25 of stiff structure 22, so that the television screen is arranged almost perpendicular over the bead of the person lying on the bed, and the position in which horizontal transverse bar 28 is respectively displaced. In addition, supporting frame 33 may be slid manually or mechanically for the entire extent of bars 34 and 35, by utilizing wheels (not shown) or similar sliding means co-operating with corresponding guide members provided along the bars. Another means of securing television receiver 32 to bars 34 and 35 is shown in FIGS. 8 and 9, wherein a plate 39 supports and secures television receiver 32 onto the bars by applying the plate to the relative bar by suitable means (for example, bands 40) permitting the plate to slide along the bar.

Obviously, according to the invention it is also possible to support and to displace the television receiver 32 in both the longitudinal and transverse directions with respect to the stiff structure 22, by utilizing means of different kind with respect to those described by way of example only, without departing from the sphere of protection sphere of the same invention.

Finally, FIGS. 10–13 show horizontal transverse bar 28 for performing gym exercises and some component parts thereof, in which it is noted that the bar is constrained to a further metallic strengthening bar 41 which is provided for securing gym equipment such as for example elongated ropes terminating with ring shaped handles (not shown) for performing physical exercises of raising and lowering the person's body, or also physical exercises of other kind. Moreover, transverse bar 28 is provided at its free end portions with wheels 42 and 43 or similar means for sliding along corresponding side guide members 38 of side edges 23 and 24, in order to displace said bar to different positions depending on need.

Figure 11:
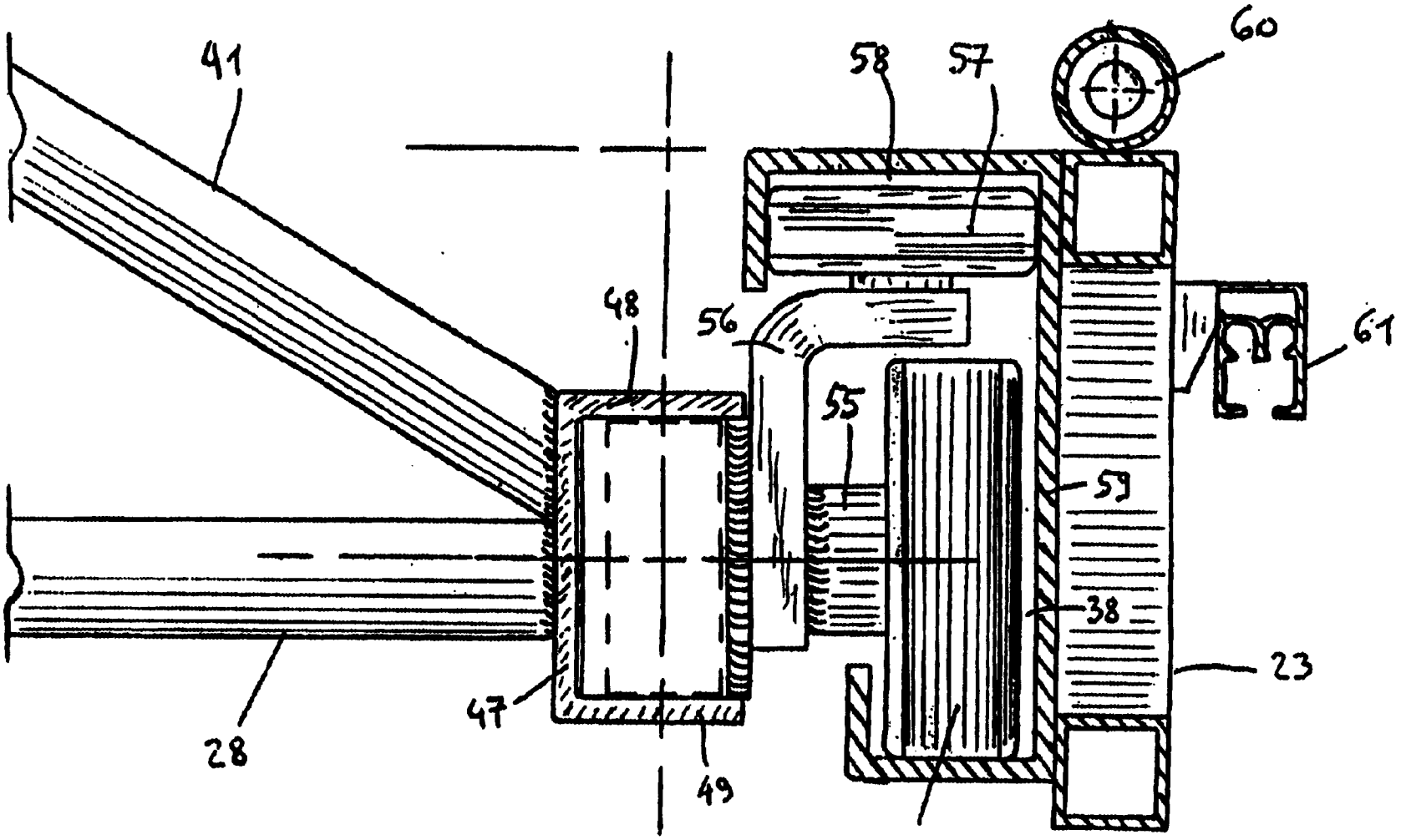
FIG. 11 is a partial side view of a cross-sectioned constructive item of the component of FIG. 10.
Figure 13:
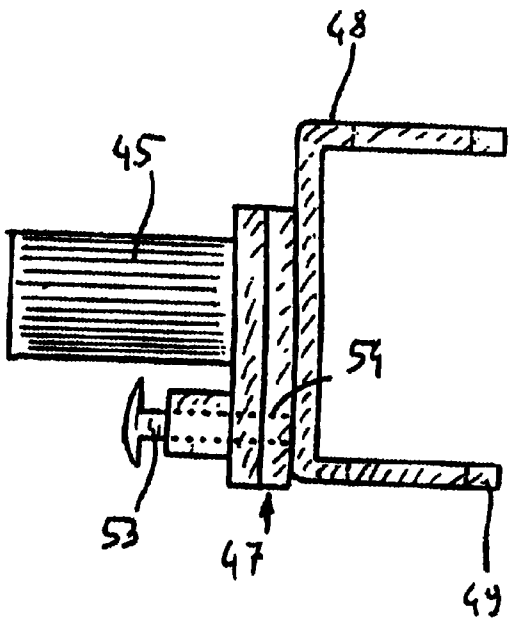
FIG. 13 is a side view of the constructive item of FIG. 11, in the assembled condition.
Figure 12:
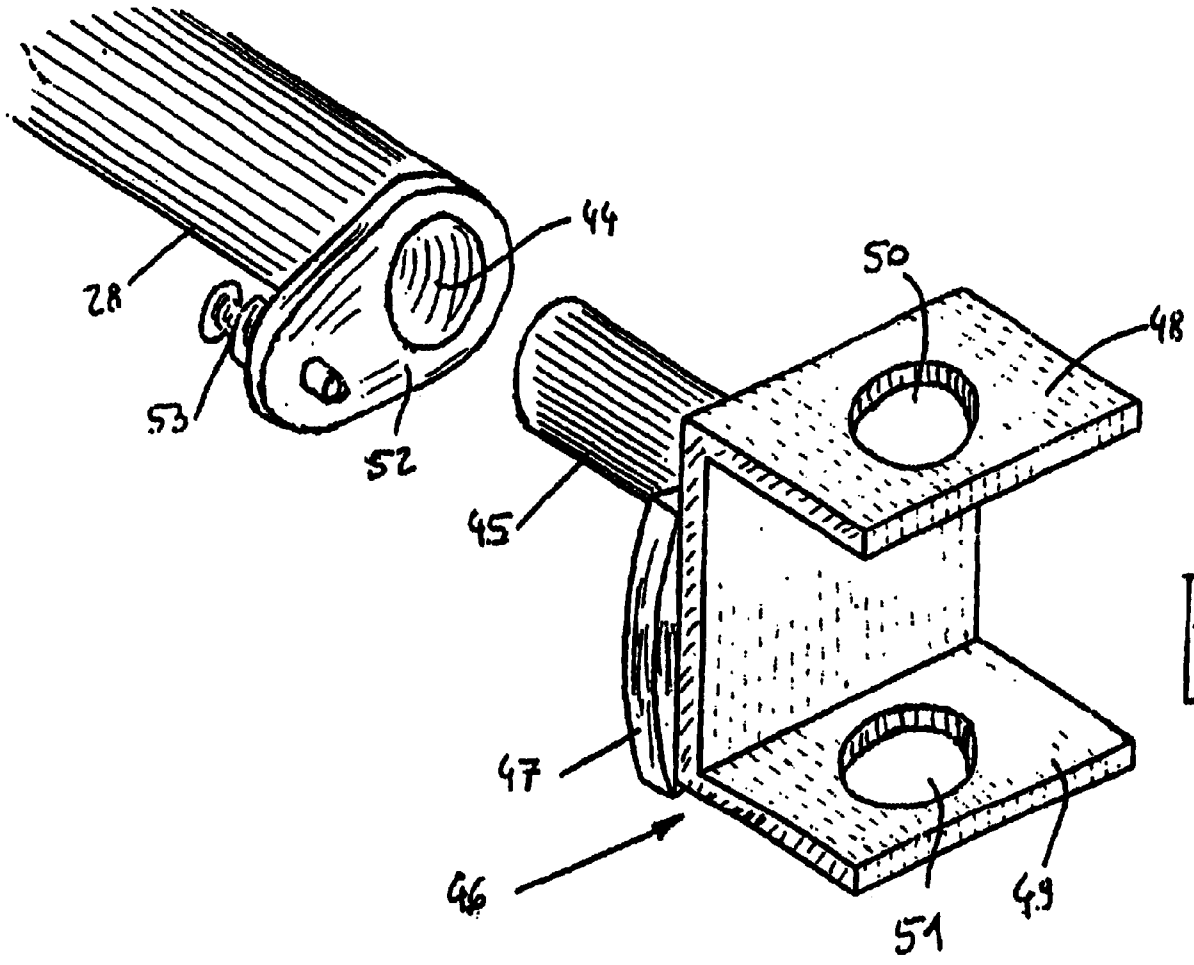
FIG. 12 is a perspective view of the constructive item of FIG. 11.

FIGS. 11–13 show a manner in which bar 28 is joined laterally to the sliding wheels (in this case, right wheel 43 is represented). Each free end portion of the bar is provided with a cylindrical blind hole 44 entering it for a certain depth, into which corresponding cylindrical tang 45 of a fork or yoke 46 can be removably inserted. The fork is formed with a vertical base 47 so formed as to constitute two rectilinear parallel and spaced apart flanges 48 and 49, in which corresponding vertical through holes 50 and 51 are provided. The free end portion of bar 28 is also joined to a side projection 52 having a horizontal sprung shank 53 fixed thereto which is adapted to be inserted into a corresponding horizontal blind hole 54 provided on the fork base 47 when tang 45 of the fork is inserted into blind hole 44 of the free end portion of bar 28, thereby providing for the reciprocal assembling of these component parts.

Wheel 43 is joined with a relative horizontal stud 55, which is secured to fork 46 by means of a pin (not shown) provided through the stud. Stud 55 is fixed to an orthogonally bent square 56, which supports another sliding wheel 57 orthogonal to wheel 43 and adapted to slide on a corresponding horizontal guide member 58, provided with an U-shaped section bar 59 forming also the side guide member 38 of wheel 43. In this way, thanks to the presence of the cited different component parts, it is possible to assemble simply and quickly bar 28 and the associated gym equipment in position, by assembling together these component parts with the described criteria.

Obviously, instead of the manner described, it is also possible to foresee different component parts for assembling the bar in position, without departing from the sphere of protection of the invention. This supporting and sliding mechanism may also be used to adjust the television receiver 32 in different angular positions. Moreover, as seen in FIG. 11, at least a lighting lamp 60, in the present case made of extended form, is applied over at least one of the side edges (in this case, the edge 23) of the stiff structure 22, in order to deflect the light upward thereby lighting up the environment. Finally, the entire bed structure is advantageously covered by a protection made of suitable material such as leather, and at least a movable outer curtain (not shown), whose upper part is slidable into corresponding horizontal side guide members 61 secured against the outer surface of the side edges and projected outwards therefrom.

What is claimed is:

1. A multi-functional bed having a horizontal support plane for supporting a mattress spring, a mattress, pillows, blankets and at least one person, said bed comprising a first and a second pair of vertical legs arranged respectively at a headboard of the bed and at a footboard of the bed, the legs of said first pair (15,16) and second pair (17, 18) being extended upward and joined together by a first stiff structure (19) arranged at a lower part and forming the bed peripheral edges (20,21) and said horizontal support plane, and joined by a second stiff structure (22) arranged at an upper part of the legs spaced vertically from said first stiff structure (19) so as to permit access to the bed, said second stiff structure (22) including peripheral edges (23,24,25,26) adapted to support at least a television receiver (27,32) and means (28) for supporting gym equipment and lighting means (60), comprising at least a horizontal transverse bar (28), wherein said television receiver (27) is a common television receiver provided with a television tube and secured onto and supported by at least a transverse bar (29) having wheels (30) sliding alternately into corresponding guide members of said second stiff structure (22), and wherein said transverse bar (28) has wheels (42,43) for sliding in guide members (38), carried by opposing edges of said second stiff structure (22), said wheels being removably attached to relative end portions of said transverse bar (28) by a coupling means (46,52).

2. The bed according to claim 1, wherein said television receiver (27) is slidable together with said transverse bar (29) from a position at a back edge (26) of said second stiff structure (22) to a position approached to a head of a person lying on the bed, or disposed perpendicularly above said person's head.

3. The bed according to claim 1, wherein said television receiver (27) is slidable for the entire extent of said transverse bar (29) and can be adjusted manually or mechanically into different angular positions with respect to the person lying on the bed.

4. The bed according to claim 1, wherein said television receiver has a flat screen (32) and is supported by supporting means secured to a pair of additional transverse bars (34, 35) having wheels (36, 37) for sliding into corresponding guide members (38) of said second stiff structure (22).

5. The bed according to claim 4, wherein said television receiver with flat screen (32) is slidable together with said supporting means (33, 39), from a position near the head of a person lying on the bed, in which the television screen is disposed almost perpendicularly to the person's head, and the position in which said transverse bar (28) is displaced, said television receiver (32) being slidable for the entire extent of said additional transverse bars (34, 35).

6. The bed according to claim 1, wherein said coupling means comprise at least a fork (46), a side projection (52) joined with each free end portion of said bar (28) and provided with a sprung shank (53) and a blind hole (44) formed in each free end portion of said bar, said fork (46) being provided with a tang (45) insertable into said blind hole (44) and a blind hole (54) into which said spring shank (53) is insertable, and said fork (46) being provided with flanges (48, 49) having a respective through hole (50, 51) for the connection with a wheel stud (55) of each wheel (42, 43) by a pin or the like, inserted through the corresponding through holes (50, 51).

7. The bed according to claim 6, wherein said wheel stud (55) is secured to an orthogonally bent square (56), supporting a sliding wheel (57), orthogonal to the respective wheel (42, 43) and slidable in a corresponding guide member (58) of said second stiff structure (22).

* * * * *